US006619008B1

(12) United States Patent
Shivak et al.

(10) Patent No.: US 6,619,008 B1
(45) Date of Patent: Sep. 16, 2003

(54) CORNER CONNECTOR FOR UPRIGHT PANELS

(75) Inventors: Vincent Shivak, Calgary (CA); Dale R. Marshall, Calgary (CA); Darren R. Long, Calgary (CA)

(73) Assignee: Smed International Inc., Calgary (CA)

( * ) Notice: Subject to any disclaimer, the term of this patent is extended or adjusted under 35 U.S.C. 154(b) by 0 days.

(21) Appl. No.: 10/166,057

(22) Filed: Jun. 10, 2002

(51) Int. Cl.[7] ..... E04H 1/12

(52) U.S. Cl. ..... 52/731.5; 52/71; 52/220.7; 52/239; 52/282.1

(58) Field of Search ..... 52/71, 220.7, 239, 52/282.1, 731.5; 16/355; 160/199

(56) References Cited

U.S. PATENT DOCUMENTS

| | | | | |
|---|---|---|---|---|
| 3,371,454 A | * | 3/1968 | Anderson | 52/126.4 |
| 4,021,973 A | * | 5/1977 | Hegg et al. | 52/36.6 |
| 4,070,808 A | | 1/1978 | Danescu | 52/122 |
| 4,104,838 A | * | 8/1978 | Hage et al. | 52/239 |
| 4,638,614 A | * | 1/1987 | Wilcox | 52/238.1 |
| 4,981,002 A | | 1/1991 | Cederholm | 52/241 |
| 5,033,526 A | | 7/1991 | DeLong et al. | 160/135 |
| 5,142,997 A | | 9/1992 | DeLong et al. | 109/49.5 |
| 5,155,955 A | | 10/1992 | Ball et al. | 52/126.4 |
| 5,363,616 A | | 11/1994 | Hernandez | 52/281 |
| 5,816,000 A | | 10/1998 | Izatt et al. | 52/238.1 |
| 6,218,612 B1 | | 4/2001 | McKitrick et al. | 174/48 |
| 6,223,485 B1 | | 5/2001 | Beck et al. | 52/239 |
| 6,226,931 B1 | | 5/2001 | Haversat | 52/71 |
| 6,244,002 B1 | | 6/2001 | Martin | 52/220.7 |
| 6,250,032 B1 | | 6/2001 | Davis et al. | 52/239 |
| 6,351,916 B2 | | 3/2002 | Militzer | 52/239 |

FOREIGN PATENT DOCUMENTS

| | | |
|---|---|---|
| DE | 38 35 606 | 4/1990 |

* cited by examiner

*Primary Examiner*—Ramon O. Ramirez
*Assistant Examiner*—Jon Szumny
(74) *Attorney, Agent, or Firm*—Flynn, Thiel, Boutell & Tanis, P.C.

(57) ABSTRACT

A corner connector arrangement which joins adjacent upright edges of at least two wall panels for maintaining the panels in angled relationship. The connector arrangement employs a connector post positioned between adjacent panel end edges. Each panel has a connecting bracket provided with outwardly protruding upper and lower flanges which respectively overlap upper and lower ends of the post. The post has suitable openings so that cabling can pass from interiorly of one panel through the post for passage into the interior of another panel. Elongate closure strips are secured to and extend longitudinally along opposite edges of the bracket associated with each panel. The closure strips have cantilevered flanges which are curved similar to and resiliently deflect into engagement with exterior peripheral surfaces on the post to enclose the post and the cabling therein. A separate closer strip that snaps onto the post may be used to enclose the post for two-panel connections.

11 Claims, 12 Drawing Sheets

CORNER CONNECTOR FOR UPRIGHT PANELS

FIELD OF THE INVENTION

This invention relates to improved corner connector arrangement for structurally joining adjacent edges of two or more upright space-dividing panels in angled relationship.

BACKGROUND OF THE INVENTION

Interior space-dividing wall panels as conventionally utilized for dividing large interior work areas into smaller areas are frequently interconnected in angled relationship to one another, and such interconnections typically require various types of corner structures for joining the adjacent angled panels together. The corner structures are oftentimes customized solely for only a specific corner relationship, either in terms of the included angle between adjacent panels and/or the number of panels being angularly joined at the corner. These corner structures typically require a significant number of different parts or components, only selected ones of which are used, depending upon the type of corner being created. This hence causes such corner structures to be more expensive and time-consuming with respect to construction and assembly thereof. In addition, some of these known corner structures do not readily permit cables, such as electrical power and/or communication cabling, to be extended therethrough.

More specifically, in many of the known interior space-dividing wall systems, it is conventional to provide a corner structure which is dedicated to the specific angle and specific number of panels being angularly joined. For example, one dedicated corner structure may be required to define a right angle corner between two connected panels, a different dedicated corner structure may be required for defining a connection between two connected angled panels which are joined in a different angular relationship such as a predefined angle of 135°, and a still different corner structure may be required in order to permit three panels to be joined at a corner, commonly referred to as a T configuration. These corner structures are not adaptable for use with different angles and/or different numbers of panels, and this imposes a severe constraint in terms of the flexibility required to provide different angular relationships between connected panels.

In other known corner connector structures, the corner connector is often provided with a plurality of vertical slots disposed in spaced relationship around a generally cylindrical post. While such connector provides an increased number of different angular positions which can be assumed between interconnected adjacent panels, nevertheless the angular relationship is still constrained by the angular positioning of the slots. Further, connectors of this type typically provide an appearance which is less than desirable, and frequently do not facilitate passage of cabling therethrough for extension between adjacent panels.

Examples of prior corner connector arrangements as utilized in interior space-dividing wall systems are illustrated in U.S. Pat. Nos. 6,218,612, 5,816,000, 5,363,616, 5,142,997, 5,033,526, 4,981,002, 4,070,808, 6,226,931, 6,244,002, 6,250,032, 6,223,485 and 6,351,916, and German Offenlegungsschrift No. DE 38 35 606 A1.

Accordingly, it is an object of this invention to provide an improved corner structure for joining at least two upright wall panels in angled relationship, which corner structure overcomes many of the structural and functional disadvantages associated with prior structures as discussed above.

More specifically, this invention relates to an improved corner connector arrangement which joins adjacent upright edges of at least two upright wall panels for maintaining the wall panels in angled relationship to one another. The improved corner connector arrangement uses a minimal number of parts which can be selectively combined to permit two or three panels to be angularly joined to and through the same corner connector arrangement, with the corner connector arrangement enabling the angled relationship between each two adjacent panels to be suitably varied through a significant angular extent without being constrained to discrete angular positions. This improved corner connector arrangement also facilitates and accommodates passage of electrical cabling therethrough, with the cabling being hidden interiorly after the corner arrangement has been fully assembled.

In the improved corner connector arrangement of the present invention, the corner connector arrangement employs an upright connector post which is positioned within the region between adjacent end edges of two or three panels to permit creation of a two or three panel joint. Each panel has a connecting bracket secured thereto and provided with outwardly protruding upper and lower flanges which respectively overlap the upper and lower ends of the connecting post. The mounting brackets and the post have suitable openings so that cabling can pass from interiorly of one panel through the openings for passage into the interior of the other panel. Elongate closure strips are secured to and extend longitudinally along opposite edges of the bracket associated with each panel. These closure strips have cantilevered flanges which are curved similar to and resiliently deflect into engagement with exterior peripheral surfaces on the post to effectively enclose the post and the cabling which passes interiorly thereof. The post can, during assembly of the corner arrangement, be rotatably displaced so as to accommodate the different angular orientation of the panels and of the closure strips to permit the passage of cabling therethrough while at the same time permit closure of the post.

Other objects and purposes of the invention will be apparent to persons familiar with constructions of this general type upon reading the following specification and inspecting the accompanying drawings.

Figure 1:
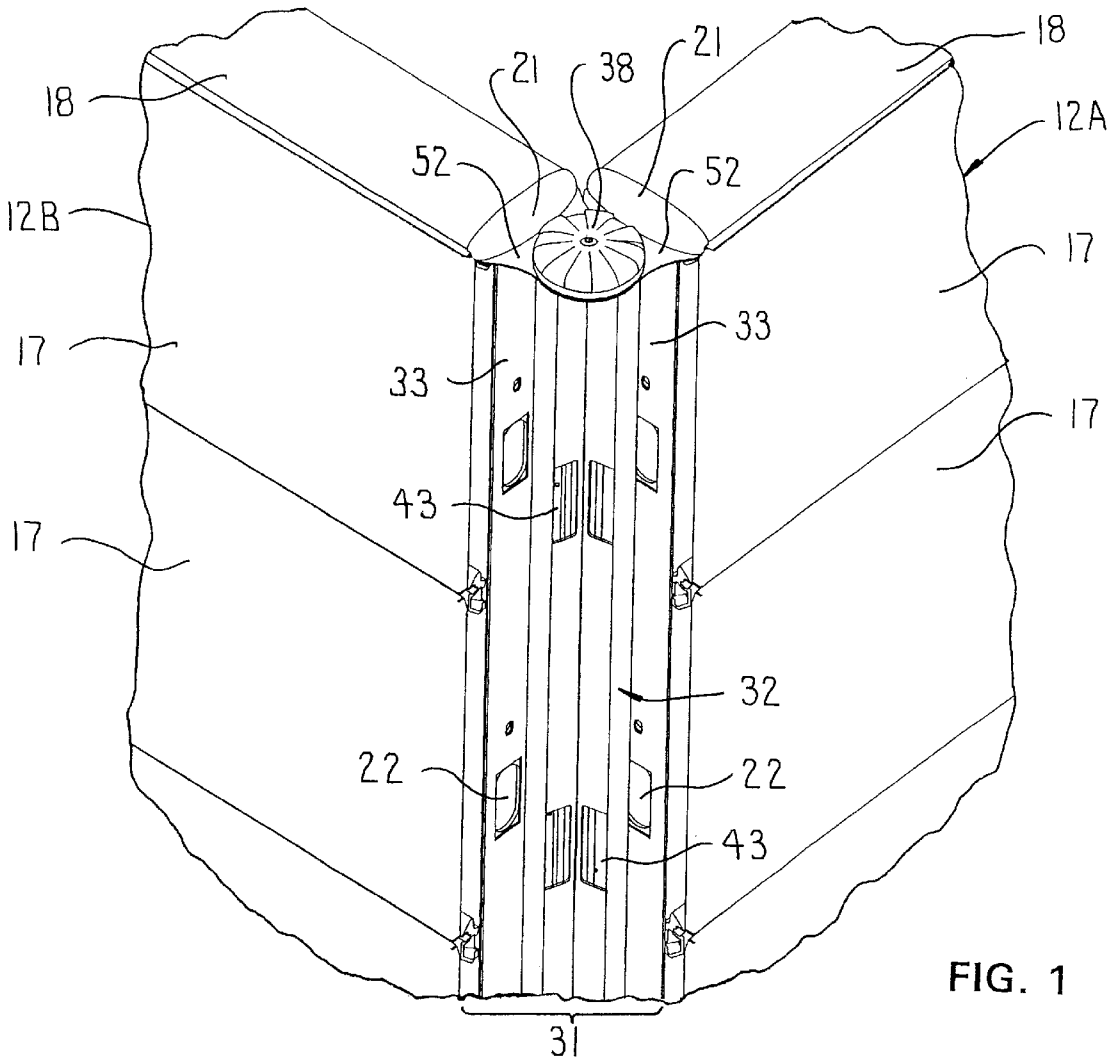
FIG. 1 is a fragmentary, top perspective view showing two angled panels joined by a partially-assembled corner connector arrangement according to the present invention.

Certain terminology will be used in the following description for convenience in reference only, and will not be limiting. For example, the words "upwardly", "downwardly", "rightwardly" and "leftwardly" will refer to directions in the drawings to which reference is made. The words "upwardly" and "downwardly" will also refer to the normal upright configuration of the wall panels and the corner connector arrangement connected therebetween. The words "inwardly" and "outwardly" will refer to directions toward and away from, respectively, the geometric center of the arrangement or designated parts thereof.

DETAILED DESCRIPTION

Figure 15:
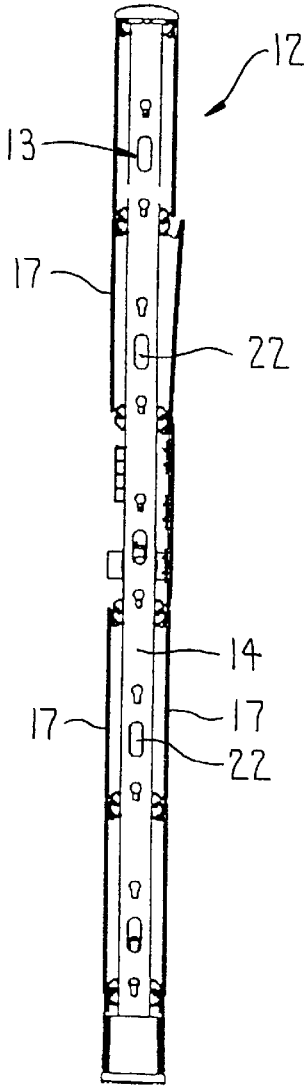
FIG. 15 is an end elevational view of the panels shown in FIG. 14.
Figure 14:
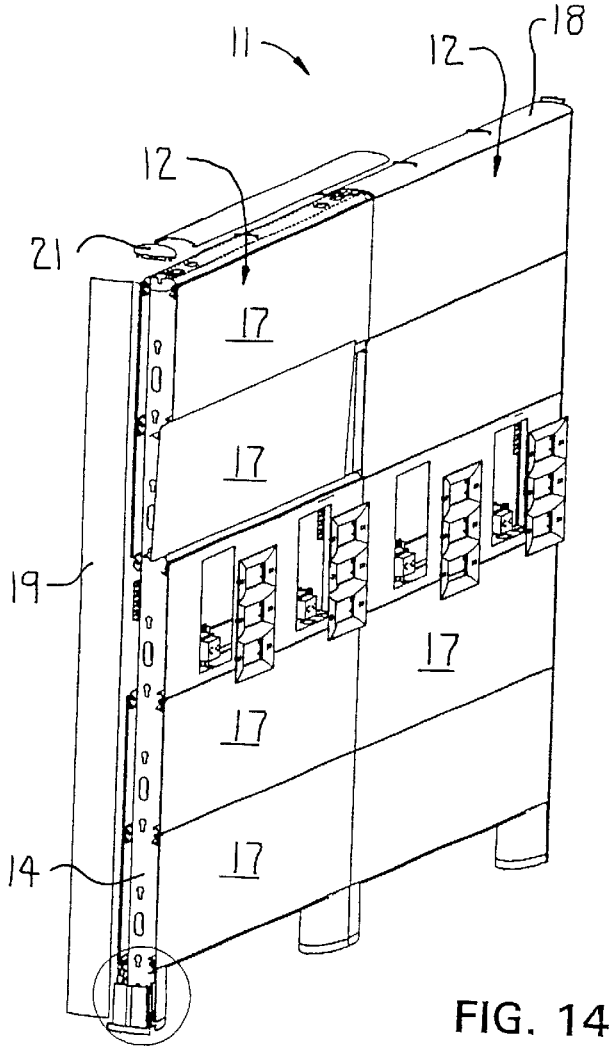
FIG. 14 illustrates a pair of upright panels which are joined together in aligned relationship.
Figure 16:
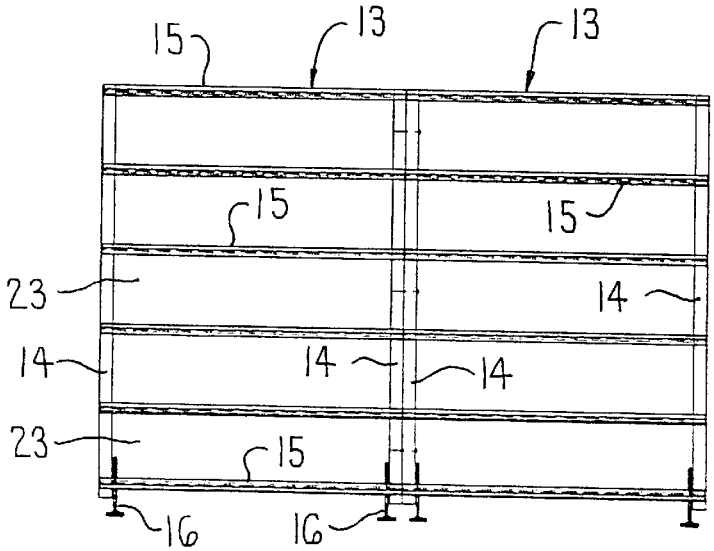
FIG. 16 illustrates the frames of the panels shown in FIG. 14.

Referring to FIGS. 14–16, there is illustrated a partial upright wall system 11 of the type utilized in offices and the like for dividing large open areas into smaller work areas. The wall system in the illustrated arrangement includes a pair of substantially identical upright wall panels 12 each having a rigid internal frame 13 defined by a pair of generally parallel edge rails or uprights 14 disposed adjacent each end of the panel, and rigidly joined by a plurality of substantially parallel cross beams 15 which extend horizontally between the uprights 14 for rigid securement therewith. The plurality of cross beams 15 typically include at least upper and lower cross beams connected between the uprights 14, and in the illustrated embodiment also include a plurality of intermediate cross beams. The frame has, in the illustrated wall panel, a pair of adjustable glides 16 fixed thereto and projecting downwardly for supportive engagement with a floor when the wall panel is in its assembled upright condition.

The wall panel 12 includes one or more covers or tiles 17 which fix to opposite sides of the frame 14 to define the exterior side surfaces of the wall panel. The covers 17 are typically provided with attachment structures, such as along upper and lower edges thereof, which cooperate with the frame to permit the covers to be detachably engaged with the frame in a conventional manner. A top cap 18 attaches to and extends lengthwise along the upper edge of the panel frame, and an end cover 19 can be provided for attachment to the exposed upright end of the wall panel. A suitable corner trim cap 21 is provided at the corner of the panel in overlying relationship to the end cover 19 and aligns and engages with the adjacent end of the top cap 18.

Each of the frame uprights 14 has a plurality of elongate slotlike openings 22 extending horizontally therethrough in vertically spaced relationship along the frame, with each of the openings 22 providing communication with an interior region or space 23 as defined interiorly of the frame between each vertically adjacent pair of cross beams 15. The interior regions 23 accommodate therein cabling, such as power and/or communication cabling, and the openings 22 in the frame uprights enable the cabling to be extended therethrough for passage between adjacent interconnected wall panels.

The wall panel 12 as illustrated in FIGS. 14–16 and as briefly described above is disclosed in detail in copending application Serial No. 09/875 263, owned by the Assignee hereof, and the disclosure of this latter application is incorporated herein by reference.

Figure 2:
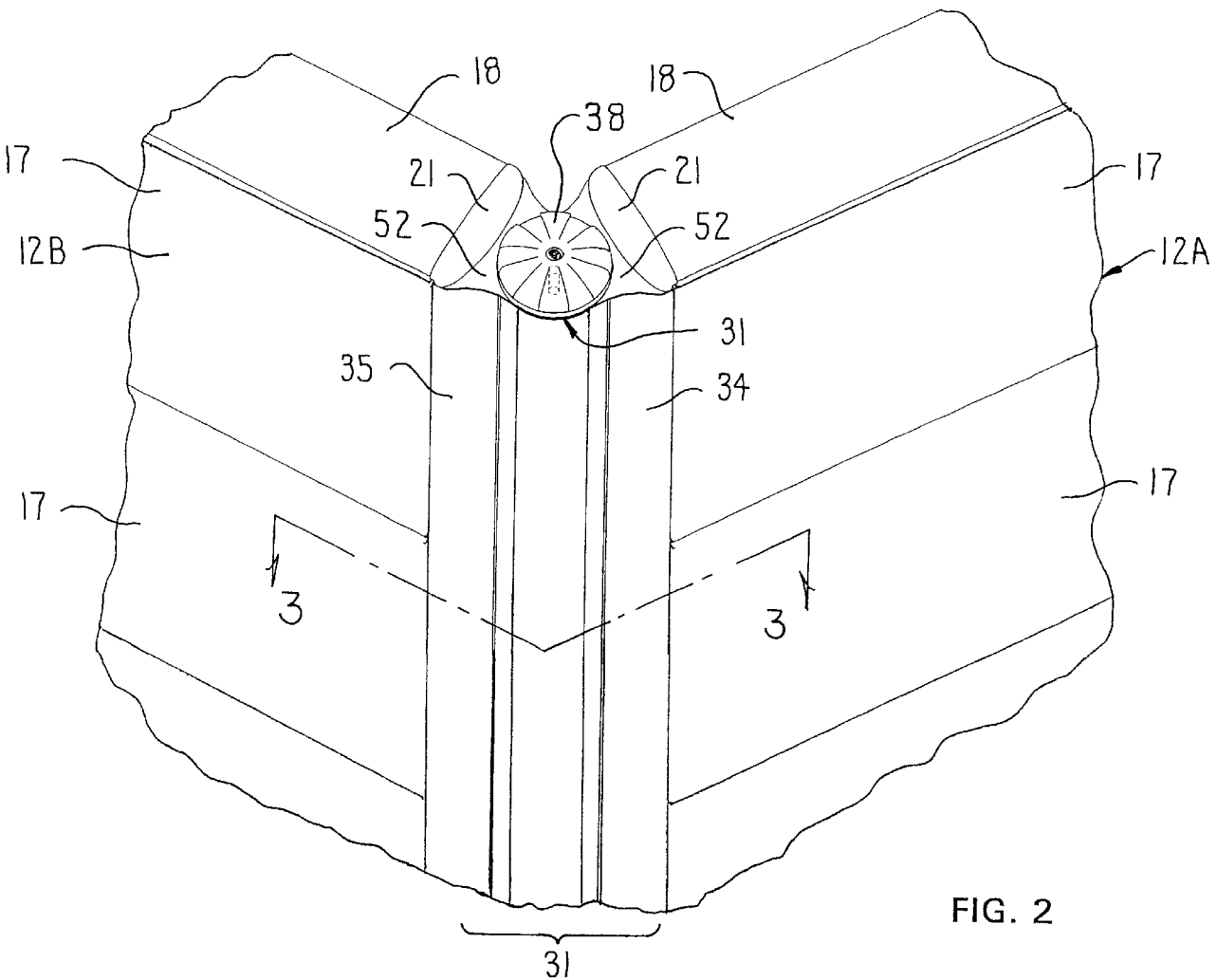
FIG. 2 is a fragmentary, top perspective view similar to FIG. 1 but showing the fully assembled corner connector arrangement.
Figure 3:
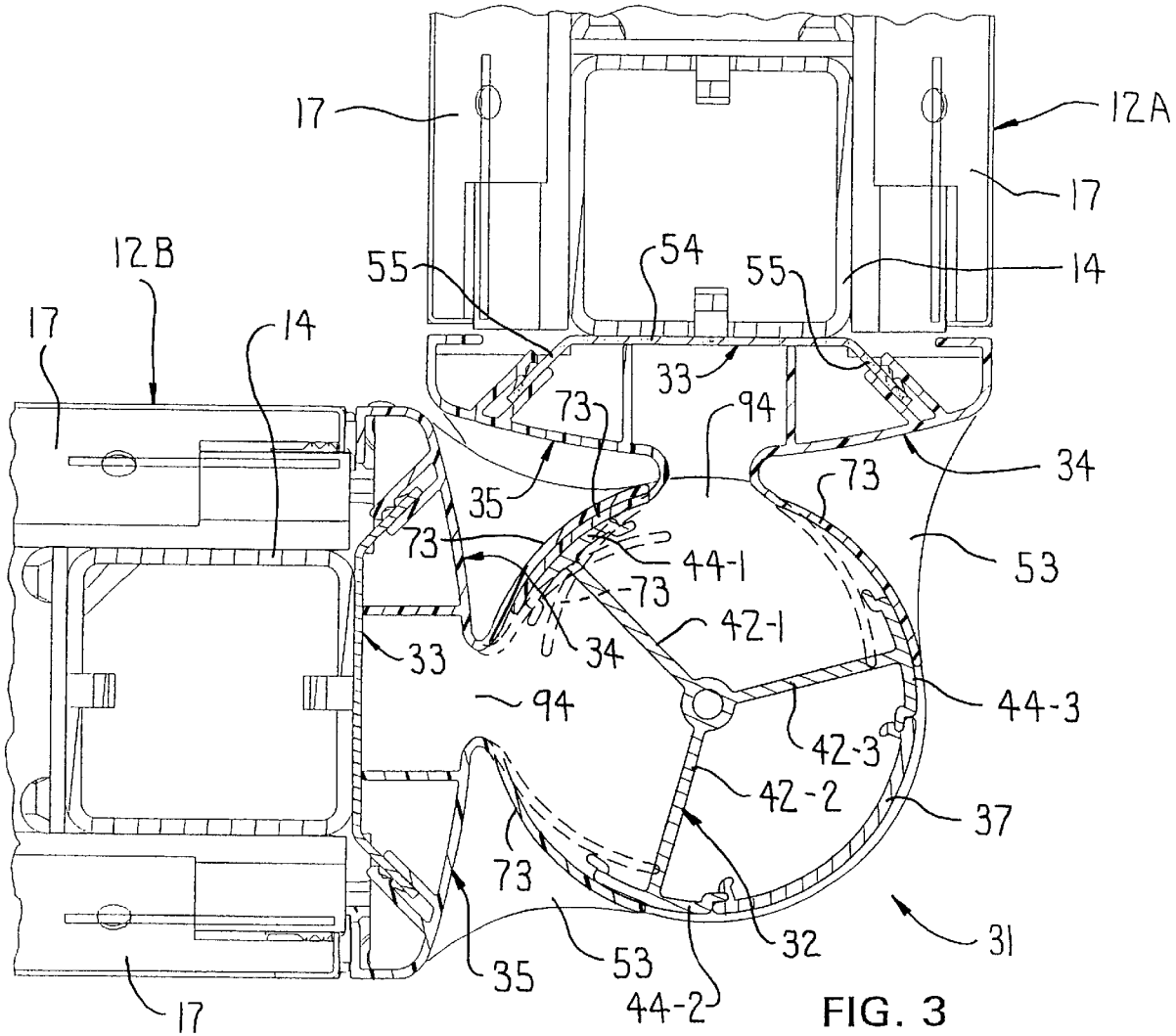
FIG. 3 is an enlarged cross-sectional view taken generally along line 3—3 in FIG. 2.

Referring now to FIGS. 1–3, there is illustrated an improved corner connector arrangement 31 according to the present invention, which arrangement is illustrated for joining together a pair of upright wall panels in angled relationship. The wall panels are designated 12A and 12B in these Figures for convenience in positional identification, but it will be understood that these panels are typically of similar construction except for possible size differences such as different heights and/or widths.

The corner connector arrangement of the present invention is defined by three structurally-different principal members, namely an upright connector post 32 which is positioned between the adjacent ends of the angularly related panels, a connector bracket 33 of which one such bracket is connected to the upright edge of each of the angularly related panels, and a connector closure strip 34, 35 of which two such strips as designated 34 and 35 are connected to the end edge of each of the angularly related panels. The closure strips 34 and 35 are identical except that the strip 35 is vertically inverted relatively to the strip 34 so that the strips 34 and 35, when mounted on the respective panel edge, effectively appear as mirror images of one another. The structure of these three principal members, namely the connector post 32, the connector bracket 33 and the connector strip 34 is described below.

The corner connector arrangement 31 optionally includes an elongate insert strip 37 which can be releasably attached to and extended lengthwise of the connector post 32. Use of the insert strip 37 is optional, and this strip will typically be used when the corner connector arrangement is used for joining two upright panels in angular relationship to one another. The corner connector arrangement 31 also typically utilizes a top cap 38 which secures to the upper end of the connector post.

Figure 4:
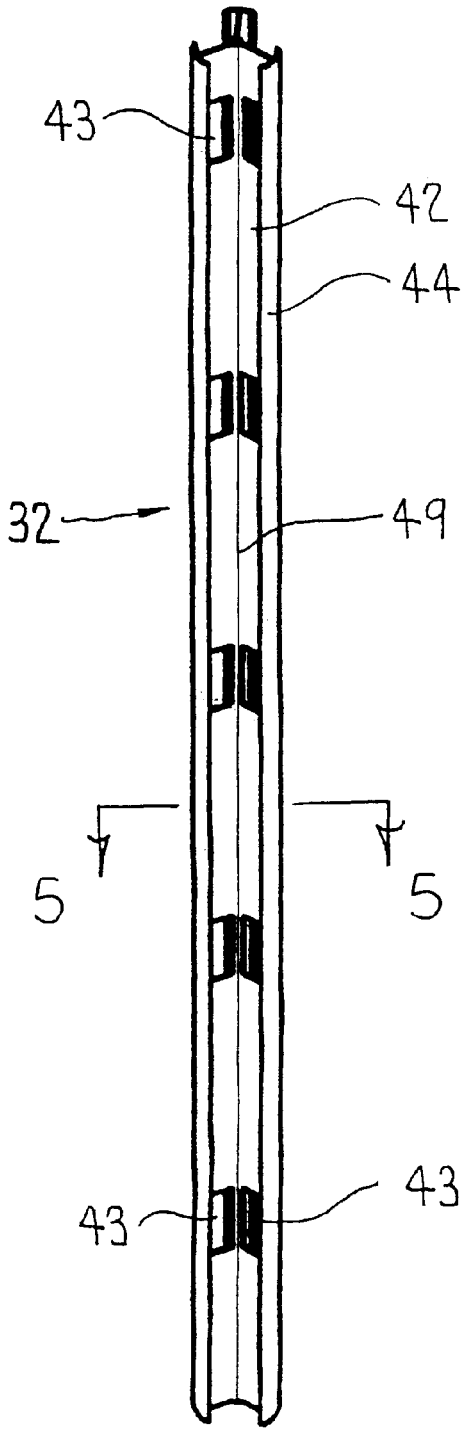
FIG. 4 is a perspective view of the connector post associated with the corner connector arrangement.
Figure 5:
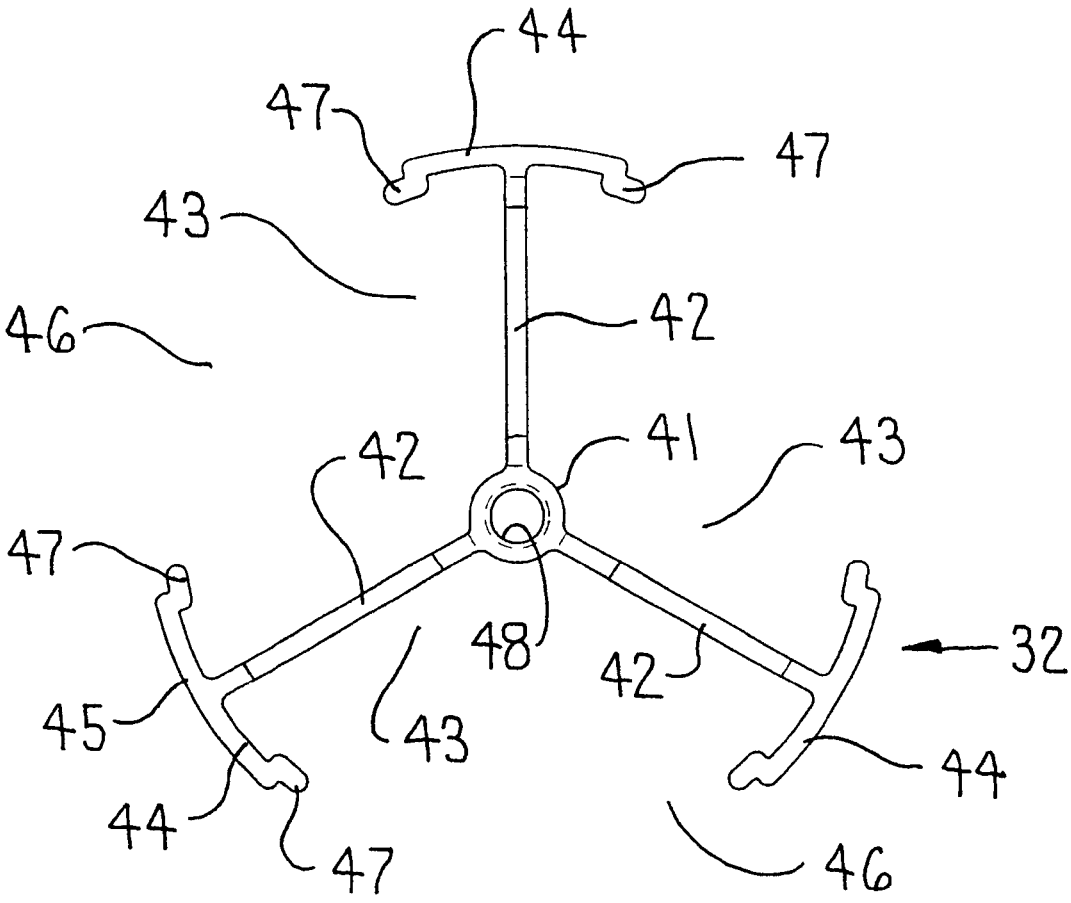
FIG. 5 is an enlarged cross-sectional view taken along line 5—5 in FIG. 4.

Regarding the construction of the upright connector post 32, and referring specifically to FIGS. 4 and 5, this post 32 comprises a one-piece vertically elongate member having a height which generally corresponds to the height of the panels 12A and 12B when the latter are of the same height. If the panels 12A and 12B are of different heights, however, then the post 32 will have a height corresponding to the height of the shortest panel.

The connector post 32 includes a longitudinally elongate center core 41 which extends vertically throughout the length of the post and defines the upright central axis 49 of the post. A plurality of divider walls 42, namely three such walls, project radially outwardly from the core 41 in generally uniformly angularly spaced relationship therearound, whereby these divider walls 42 hence define longitudinally elongate slots 43 between the adjacent divider walls 42. The radially outer edge of each divider wall 42 joins to a transverse edge wall 44 which is cantilevered outwardly from opposite sides of the respective divider wall 42, but which extends lengthwise along the divider wall throughout substantially the entire longitudinal length of the connector post. The transverse edge wall 44 defines thereon a convexly curved outer surface 45 which is generated on a radius defined about the central axis 49, whereby the outer surfaces 45 of the edge walls 44 are generated on a substantially cylindrical profile.

The transverse edge walls 44 are of relatively short circumferential extent, whereby there is defined a rather wide mouth or opening 46 between circumferentially adjacent edge walls 44, which mouth 46 provides ready access into the respective elongate slot 43. The longitudinally extending edge 47 of each edge wall 44 is suitably deformed so as to define a part or catch for engagement with the insert strip 37 if the latter is utilized.

The center core 41 of the connector post, at each of the upper and lower ends thereof, is provided with a threaded opening 48 which opens axially inwardly thereof so as to accommodate a threaded securing screw when the connector post 32 and brackets 33 are joined together.

Each divider wall 42 of the post 32 also has a plurality of openings or windows 43 extending therethrough, which windows are elongated longitudinally of the post, and are disposed in longitudinally spaced relationship along the post. The windows 43 are positioned such that all of the divider walls have an opening or window 43 therethrough at substantially the same elevation, and the elevation or location of the windows in the connector post 32 are positioned so that the windows or openings 43 are disposed at substantially the same elevation as the openings 22 associated with panel frame uprights 14.

The post 32 may be constructed of any suitable material having the desired strength and rigidity but, in the preferred embodiment, is constructed of aluminum.

Figure 6:
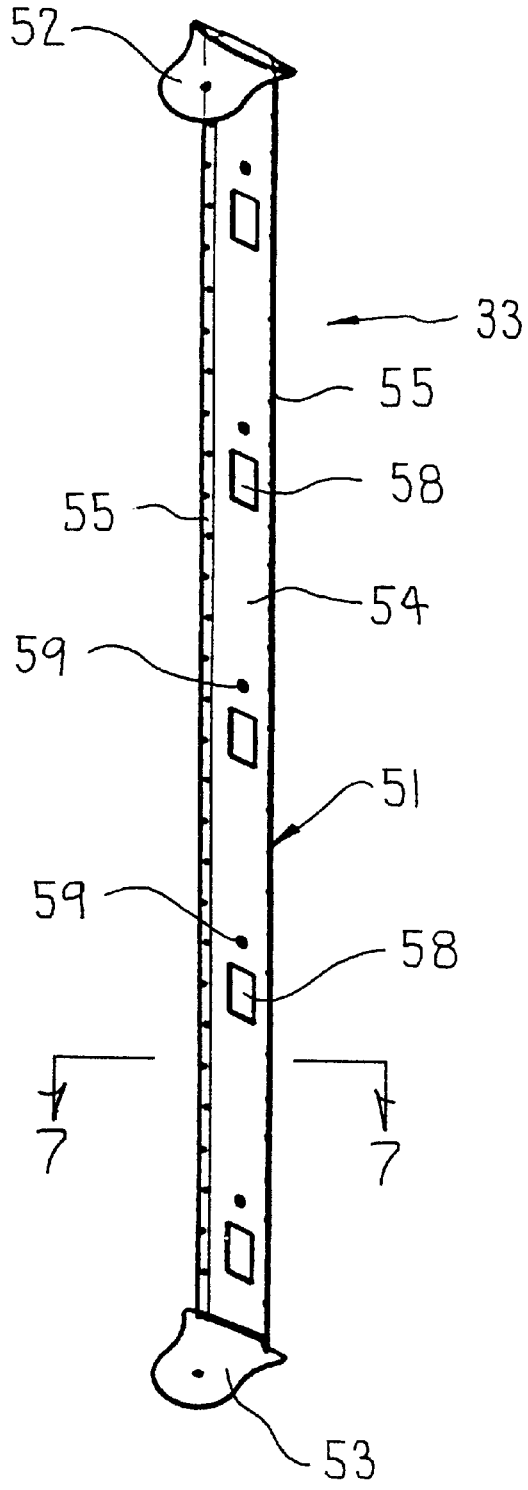
FIG. 6 is a perspective view of the connector bracket associated with the corner connector arrangement.
Figure 7:
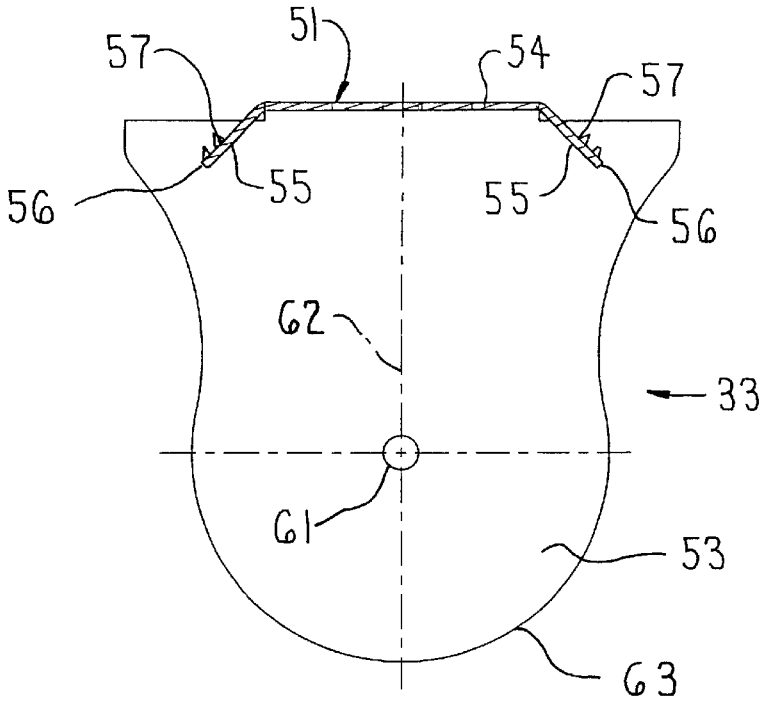
FIG. 7 is an enlarged cross-sectional view taken along line 7—7 in FIG. 6.

Considering now the connector bracket 33 and referring specifically to FIGS. 6–7, this bracket comprises a one-piece member having a shallow U-shaped cross section defined principally by a vertically elongate base part 51 which at upper and lower ends thereof is rigidly joined to respective upper and lower leg or flange parts 52 and 53 which project transversely away from the base part 51. These flange parts 52 and 53 project generally horizontally in the assembled condition, and project transversely in the same direction away from the base part 51.

The vertically-elongate base part 51, when viewed in horizontal cross section, has a generally flat platelike base wall 54 which adjacent the vertically extending side edges thereof is fixedly and integrally joined to side flanges 55 which are bent so as to angle outwardly from the base wall 54. The side flanges 55 each project transversely outwardly from the base wall 54 through a relatively short extent so as to terminate at a free edge 56 which extends longitudinally of the base part. The side flanges 55 are angled transversely outwardly so that they project at an angle relative to the plane of the base wall 54 and also extend at an angle relative to a vertical plane which transversely intersects the base wall 54. The side flanges 55 as disposed adjacent opposite sides of the base wall also extend in angled relationship to one another due to these side flanges respectively projecting outwardly away from the base wall as they also project angularly in transverse relation thereto. In the illustrated and preferred embodiment each of the side flanges 55 is transversely angled such that the included angle between the base wall 54 and the respective side flange 55 is in the neighborhood of 135° (that is, each of the side flanges is bent transversely at an angle of about 45° relative to the plane of the base wall 54).

Each side flange 55, in the vicinity of the free edge 56 thereof, has a series of transverse tabs 57 deformed sidewardly therein, which tabs are provided at spaced intervals longitudinally along the length of the side flange.

The base wall 54 has a plurality of vertically elongate openings or slots 58 formed centrally therethrough in vertically spaced relationship therealong, which openings 58 are sized and positioned so as to substantially horizontally align with the openings 22 provided in the frame upright 14 when the connector bracket 33 is attached thereto. For this latter purpose, the base wall 54,has a series of small openings 59 therethrough which accommodate therein securing screws (not shown) which permit the connector bracket 33 to be attached to the frame upright 14. The openings 59 are preferably slightly vertically elongated so as to permit slight vertical positional adjustment of the connector bracket 33 relative to the panel frame upright.

Regarding the flange parts 52 and 53 as provided adjacent the upper and lower ends of the base part 51, each of these flange parts projects generally horizontally from the vertically-oriented base plate 54, and each flange part has a small opening 61 extending vertically through a center portion thereof, which opening 61 is disposed generally within a vertical plane 62 which perpendicularly intersects the longitudinally extending vertical centerline of the base wall 54. The opening 61 is spaced a substantial distance outwardly from the base wall 54. This latter spacing slightly exceeds the radius of the connector post 32 so that the opening 61 can be disposed in alignment with the threaded opening 48 associated with the end of the connector post 32.

The upper and lower flange parts 52 and 53 are also preferably provided with outer edges 63 which are generally of an arcuate and substantially semicircular configuration generated generally about the center of the opening 61, with the radius of this outer edge 63 being similar in magnitude to the radius of the corner post 32 so that these flanges 52 and 53 effectively close off the upper and lower ends of the connector post 32 when assembled therewith.

Figure 9:
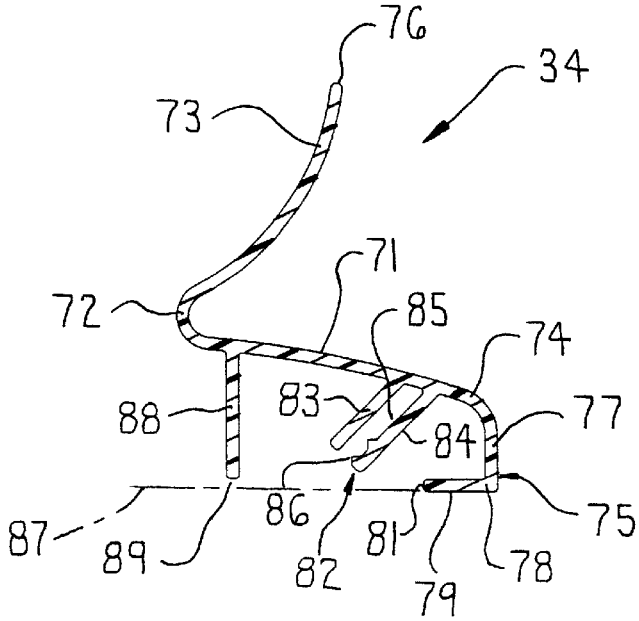
FIG. 9 is an enlarged cross-sectional view taken along line 9—9 in FIG. 8.
Figure 8:
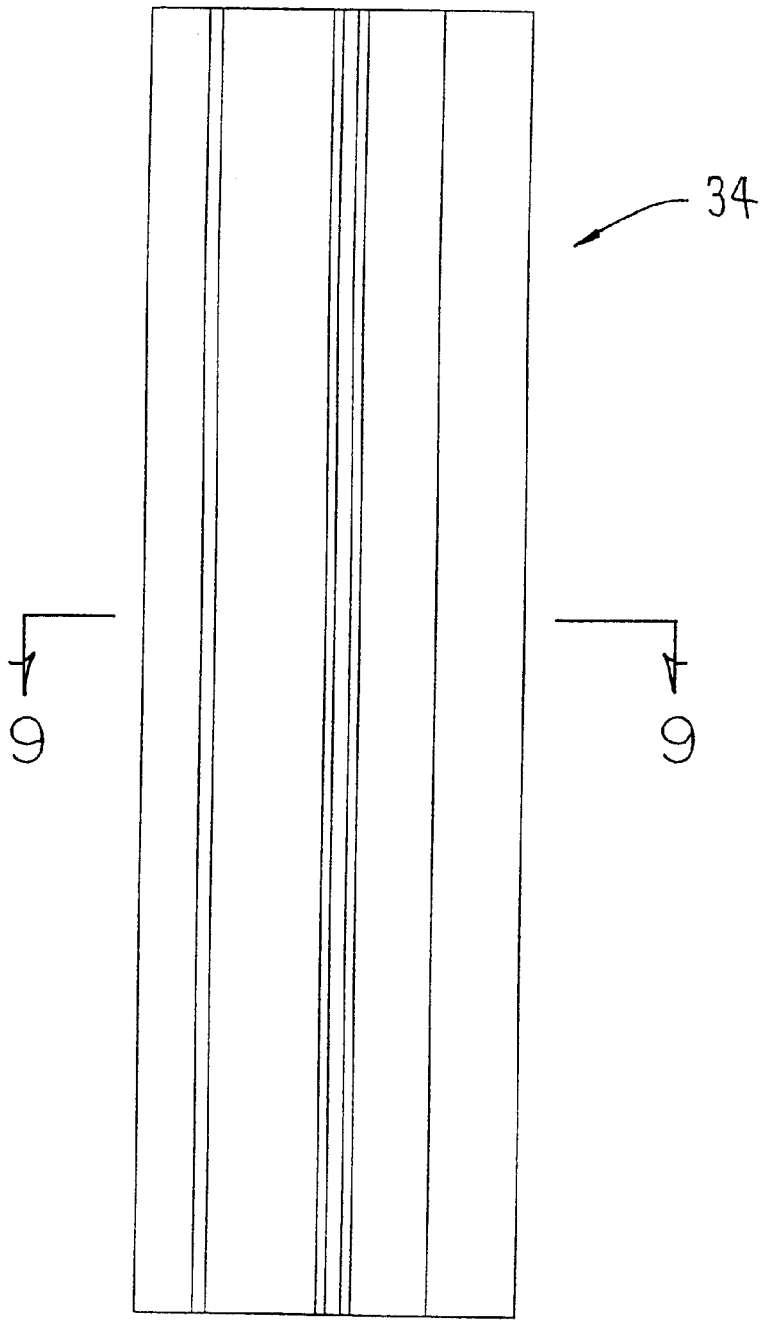
FIG. 8 is an elevational view of the connector closure strip associated with the corner connector arrangement.

Referring now to FIGS. 8 and 9 which illustrate therein the connector closure strip 34, this latter strip comprises a one-piece vertically elongate element which is preferably formed of a plastics material, for example by means of plastic extrusion, so as to have sufficient resiliency and elasticity so that the outer flange or leg thereof may maintain a position of resilient engagement with an outer wall of the connector post 32, as described hereinafter.

The connector closure strip 34, as illustrated in FIG. 9, has a generally Z-shaped cross section which is defined by an elongate center leg 71 which at one end is joined through a curved portion 72 to a first cantilevered flange or leg 73. The center leg 71 at its other end is joined through a further curved portion 74 to a second cantilevered flange or leg 75.

The cantilevered flange or leg 73, in cross section, has a smoothly curved arcuate configuration which extends from the curved portion 72 to the free end or edge 76, with the arcuate curvature of the flange 73 on the outer exposed surface thereof (i.e., the surface which faces away from the center part) being concave and configured with a radius similar to that which defines the cylindrical outer surface 44 associated with the connector post 32. The curved portion 72 which joins the flange 73 to the center leg 71 extends through a curvature which approaches 180°, whereby the flange 73 initially projects in a direction so that it partially overlies the center leg 71 with the curvature of the flange 73 then causing the flange to project outwardly in transverse relation to the center leg 71 as the flange 73 approaches its free edge 76.

The second flange 75 as associated with the other end or edge of the center leg 71 is of a generally L-shaped cross section and includes a first flange part 77 which joins to the curved portion 74, the latter being reversely curved relative to the curved portion 72 and defining an angle of about 90° relative to the center leg 71, whereby this first flange part 77 extends transversely away from the part 71 in the opposite direction from the first flange 73. The first flange part 77 at its other end is joined through a generally right-angle corner 78 to a second flange part 79 which projects transversely inwardly so as to terminate at a free edge 81. The flange parts 77 and 79 are each of short extent relative to the first flange 73, and the L-shaped configuration defined by the flange parts 77 and 79 results in the flange part 81 projecting in a direction which approximately parallels the center part 71.

The closure strip 34 also has a channel structure 82 associated therewith and functioning as a securing structure. This channel structure 82 is joined to and cantilevered inwardly from the inner side of the center part 71 so as to be positioned in the region between the center part 71 and the flange part 79. The channel structure 82 includes a pair of generally parallel side walls 83–84 which are joined to the center part 71 and project in transverse relationship therefrom so as to define a narrow space or slot 85 therebetween. At least one of these side walls, such as the wall 84, is provided with one or more retaining ribs 86 which are formed on the inner surface of the wall adjacent the free end thereof, with these retaining ribs projecting transversely into the slot and extending lengthwise along the channel structure. The side walls 83–84, and the slot 85 defined therebetween, are transversely angled inwardly from the center part 71 such that the walls and slot extend at an acute angle relative to a plane 87 as defined by the bottom flange part 79, with the slot 85 as it projects outwardly being positioned to effectively intersect this plane at a location spaced from the free edge 81 of the flange part 79. The channel structure 82, in the preferred embodiment, intersects the plane 87 at an angle of about 45°.

The connector closure strip 34 also has a stop flange 88 which extends longitudinally throughout the length of the connector strip and which is cantilevered transversely outwardly from the inner side of the center part 71 in the vicinity of the opposite end thereof, namely adjacent the curved portion 72. The stop flange 88 is cantilevered outwardly a substantial extent and terminates in a free edge 89 which is positioned closely adjacent, but in the preferred embodiment, slightly spaced from, the plane 87. This stop flange 88 as it projects from the bite part 71 also preferably extends in generally perpendicular relationship to the plane 87. The stop flange 88 is spaced a substantial distance from the free edge 81 of the flange part 79, thereby defining a substantial opening therebetween which provides ready access to the securing channel structure 82.

While the above description relates to the closure strip 34, it will be apparent that this identical description also relates to the closure strip designated 35 inasmuch as the strips 34 and 35 are identical, with the strip 35 involving solely a 180° vertical rotation of the strip 34.

Figure 10:
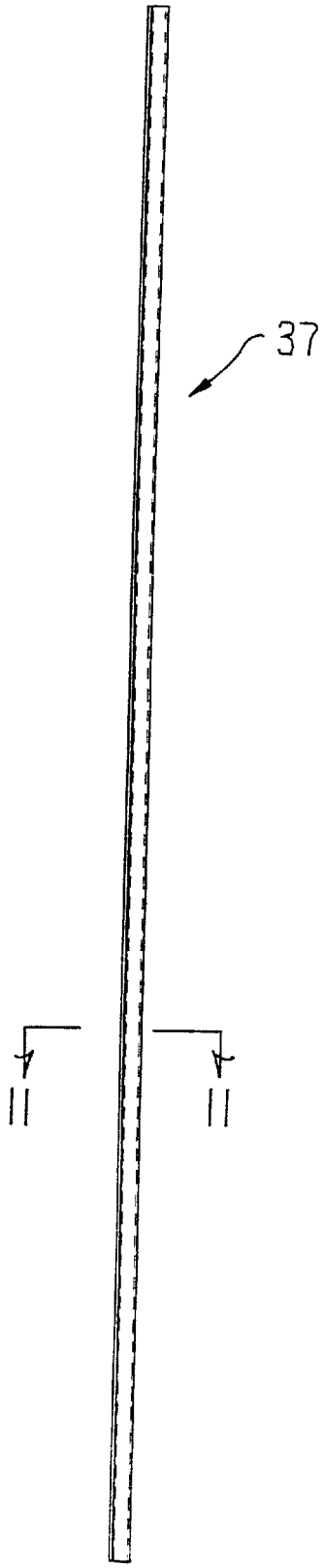
FIG. 10 is an elevational view of the insert strip which can optionally be utilized with the corner connector arrangement.
Figure 11:
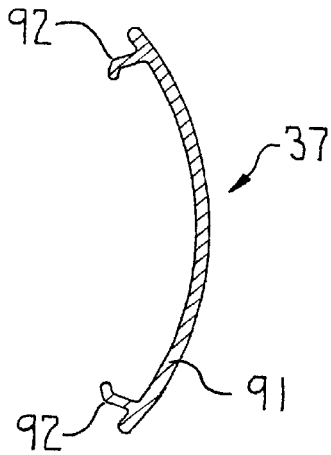
FIG. 11 is an enlarged cross-sectional view taken along line 11—11 in FIG. 10.

The corner connector arrangement 31, when used for joining two wall panels in angular relationship, also preferably utilizes the insert strip 37 as illustrated in FIGS. 10–11. The latter strip 37 preferably comprises a vertically-elongate one-piece strip which is typically formed of a plastics material, such as being extruded from plastics material, and is defined principally by a thin elongate wall 91 of arcuate configuration which, adjacent opposite edges thereof, has small flanges 92 cantilevered inwardly therefrom. The arcuate wall 91 associated with the insert strip 37 is defined by a radius which generally corresponds with the outer radius of the connector post 32, and the arcuate extent of the wall 91 generally corresponds to but slightly exceeds the angular extent of the window 46 defined between circumferentially adjacent edge walls 44, whereby the flanges 92 create a resilient engagement with the edge parts 47 to enable the insert member 37 to close off the window 46 and define a substantially continuous arcuate wall profile on the post.

The corner connector arrangement 31, and its connection between two angularly related panels such as the panels 12A and 12B in FIG. 3, will now be briefly described.

The adjacent edges of the panels which are to be interconnected through the corner connector arrangement 31 are each initially provided with a connector bracket 33 attached thereto. The panels 12A and 12B are disposed with their edges in adjacent relationship and positioned so that the connector post 32 can be interposed vertically between the upper and lower flanges 52–53. The brackets 33 are suitably vertically adjusted relative to the panels and relative to one another such that the flanges 52–53 associated with the bracket of one panel are disposed to respectively vertically overlie the flanges 52–53 associated with the bracket on the other panel, and the post 32 is vertically interposed between these flanges. The top cap 38 is then positioned on top of the uppermost flange 52 and a screw member inserted vertically therethrough and through the flange openings 61 so as to be threadably engaged into the threaded opening 48 provided in the upper end of the connector post. A similar screw is inserted upwardly through the openings 61 in the overlying bottom flanges for threaded engagement into the threaded opening at the lower end of the post. The corner connector arrangement is thus partially assembled, substantially as illustrated in FIG. 1. Prior to tightening of the connecting screws, the panels are preferably relatively angularly moved so as to provide ready access to the panel edges.

One of the connector strips is then attached to each of the panel edges. For example, if the panels are ultimately to be positioned generally in right angle relationship to one another as illustrated in FIG. 3, then with the panels in more widely angled relationship, the connector strip 35 associated with the panel 12A and the connector strip 34 associated with the panel 12B are initially mounted on the respective panels. For example, the connector strip 35 is mounted on its panel 12A by moving the connector strip inwardly toward the edge of the panel so that the side flange 55 on the bracket member is inserted into the channel structure 82, which insertion continues until the stop flange 88 substantially abuts against the base wall 54 of the bracket member. When so positioned, the retaining ribs 186 lock behind the tabs 57 on the edge flange to prevent the closure strip from being readily moved outwardly. Also in this mounted position the L-shaped flange 75 of the closure strip is disposed so that the flange part 77 is substantially coplanar with the outer surface of the cover tiles 17, and other flange part 79 protrudes inwardly directly adjacent but preferably slightly spaced from the vertical edges of the cover tiles.

When the aforementioned closure strips 34 and 35 have been mounted on the panels 12B and 12A respectively, and the panels have been angularly moved so as to be substantially in right angle relationship to one another, the deflectable legs or flanges 73 thereof substantially overlap, and the outermost one of these flanges protrudes sufficiently such that the free end thereof projects to a point where it is substantially within the curved portion 72 and hence is supportingly engaged with the flange of the other closure strips.

Thereafter the post 32 is suitably rotated relative to the brackets such that one of the radial divider walls 42 (the wall designated 42-1 in FIG. 3) is positioned so that it projects radially generally midway between the panels, which results in the edge wall 44-1 being disposed in supportive engagement with the innermost one of the deflectable flanges 73. This also results in channel-like spaces 94, when the corner connector arrangement is fully assembled, being aligned with respective longitudinally-elongate post slots 43 and with the openings 22 which access the interior of the panels so as to permit cabling (power and/or communication cabling) to pass from the interiors of the panels through the interior of the post.

With the post properly positioned as described above, the screws can then be tightened to maintain the post in position. Thereafter the remaining closure strips, such as the strip 34 for the panel 12A and the strip 35 for the panel 12B, are mounted on the panels in the same manner as described above. The deflectable flange 73 associated with the closure strip 34 of panel 12A is supportingly engaged with the peripheral wall associated with one of the other divider walls of the post, and in similar fashion the deflectable flange 73 associated with the closure strip 35 of the panel 12B is engaged with the remaining edge wall. In this manner the flanges 73 effectively form an outer rounded wall for at least partially enclosing the post.

With a two-panel angled connection as illustrated by FIG. 3, the slot defined between the divider walls 42-2 and 42-3 remains accessible. To provide improved visual appearance, the mouth of this slot is preferably closed off by mounting the insert strip 37 in the window defined between the outer edge walls associated with the edge walls 44-2 and 44-3. The strip 37 is easier to install if installed before the closure strips 34 and 35. The finished connector assembly then has an appearance which is generally illustrated in FIG. 2.

With the connector arrangement 31 assembled between the panels which are positioned in angled relationship, such as a right-angle relationship as illustrated in FIG. 3, cabling can be fed from the interior of one panel through the post into the interior of the other panel, which feeding of the cabling is carried out prior to mounting of the second closure strip on each of the wall panels, so that the cabling hence becomes totally internally positioned within and passes through the corner connector arrangement. The interior of the connector arrangement is suitably closed and screened by the closure strips 34–35 and the insert strip 37 if optionally used.

Figure 12:
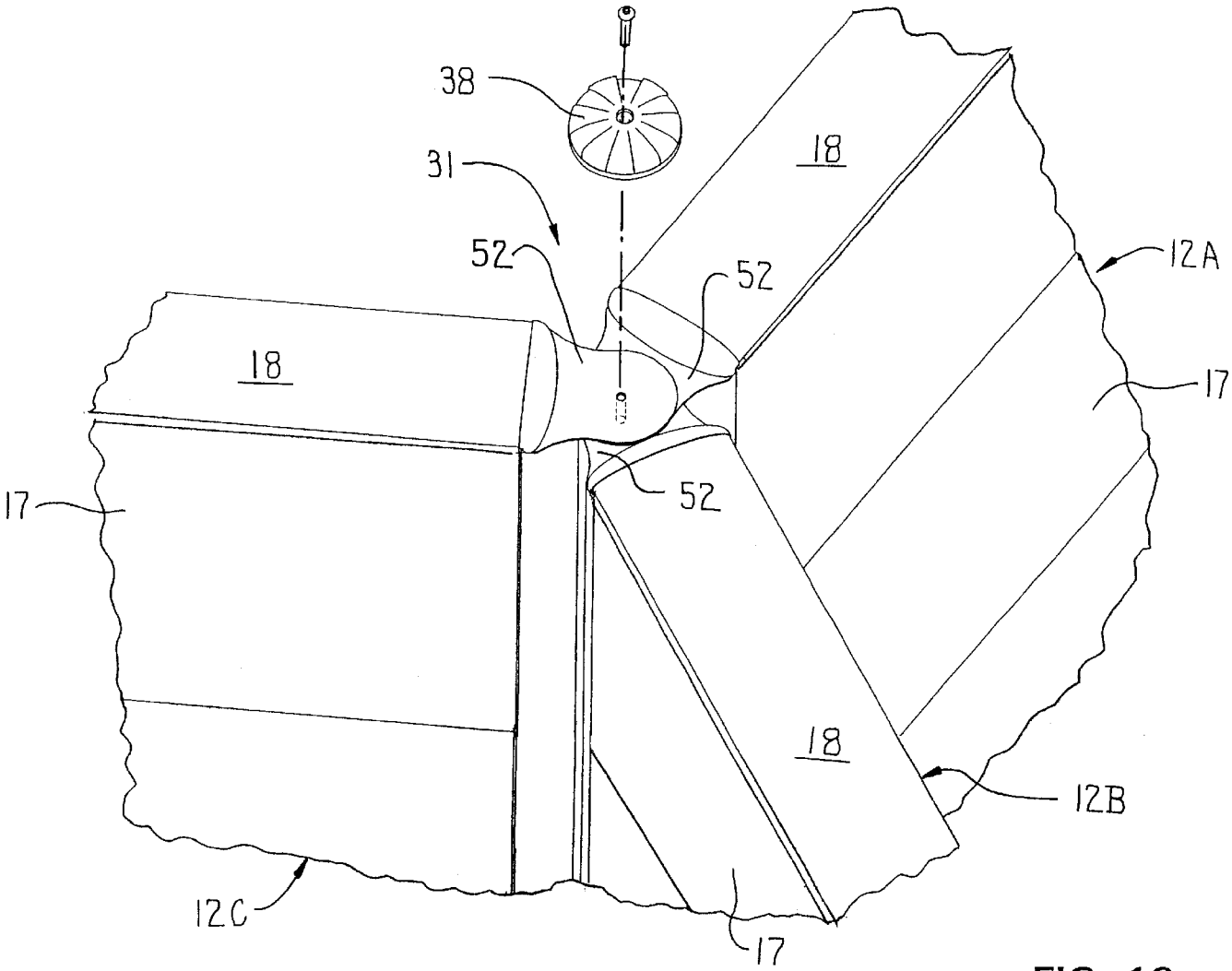
FIG. 12 is a top perspective view similar to FIG. 2 but illustrating the corner connector arrangement joined between three angularly-related panels.
Figure 13:
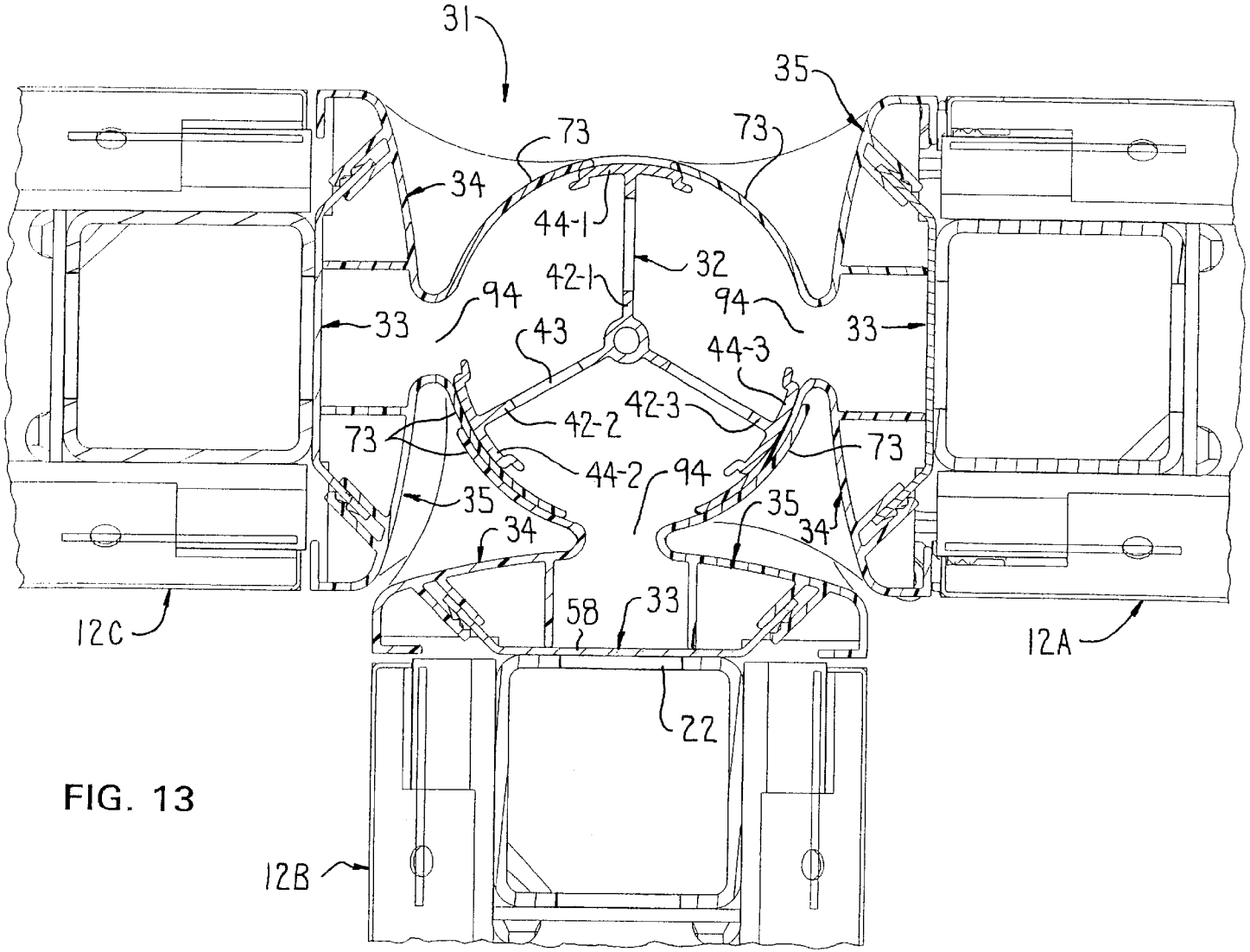
FIG. 13 is an enlarged cross-sectional view through the three-panel connector arrangement of FIG. 12.

The corner connector arrangement 31 of the present invention can also accommodate the connection of three angularly related panels, such being diagrammatically illustrated by FIGS. 12 and 13. Specifically as illustrated by FIG. 13, the three panels designated 12A, 12B and 12C are disposed in angled relationship with respect to one another, and each has a pair of connector strips 34–35 mounted thereon which cooperate in the same manner as with a two-panel connection as described above. With the three-panel connection, however, the flanges 73 associated with the closure strips cooperate with the edge walls of the post so as to effect total closing of the post, provided that the post is properly angularly positioned relative to the panels, whereby use of a separate insert strip 37 is not required.

While FIG. 13 illustrates the panel 12B positioned between and in right-angled relationship to each of the panels 12A, and 12C, it will be recognized that the three panels can also be disposed in different non-perpendicular angular relationship with respect to one another since the connector arrangement 31 readily permits each pair of adjacent panels to be angularly displaced with respect to one another through an angular range extending from about 90° to about 270°, and hence the individual panels can be positioned at any location within this range.

While the corner connector arrangement of the present invention is illustrated in relationship to a wall panel of the type illustrated herein, and as described in Assignee's copending application Serial No. 09/875 263, it will also be appreciated that the corner connector arrangement of this invention is also applicable for use with numerous other conventional panel constructions, and that the panels illustrated and described herein are merely exemplary relative to the corner connector arrangement of the present invention.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A corner connector arrangement for joining adjacent upright end edges of first and second angularly-related upright space-dividing wall panels, comprising:

first and second bracket structures fixed to an upright end edge of said first and second wall panels respectively, each said bracket structure including upper and lower flanges which project horizontally outwardly from the upright end edge of the respective wall panel;

a vertically elongate connector post positioned between said upright end edges of said first and second wall panels so that said upper flanges overlie an upper end of said post and said lower flanges underlie a lower end of said post, said post and said flanges being structurally connected together;

said connector post including at least three peripheral edge walls which extend along the length of the post and are angularly spaced apart to define access spaces therebetween which provide access to the interior of the post; and first and second vertically-elongate closure strips mounted on said upright end edge of each said wall panel and extending lengthwise therealong adjacent opposite sides thereof, each said closure strip having a resiliently-deflectable cantilevered flange which projects circumferentially partially around said post and is resiliently urged radially inwardly so as to be engageable with a peripheral edge wall of said post, said resiliently-deflectable cantilevered flanges as associated with said first and second closure strips projecting away from one another in circumferentially opposite directions relative to said post.

2. The arrangement according to claim 1, wherein each said post includes three angularly-spaced divider walls which project radially outwardly from an upright central axis of the post and each of which at a radially outer end joins to a said peripheral edge wall which extends circumferentially of the post through only a small arcuate extent, whereby each adjacent pair of peripheral edge walls define an arcuate space therebetween which opens radially inwardly for communication with a longitudinally elongate slot as defined between adjacent divider walls.

3. The arrangement according to claim 2, wherein each of the divider walls has an opening therethrough at a similar elevation for permitting horizontal passage of cabling through the divider walls.

4. The arrangement according to claim 1, wherein said closure strip is a one-piece elongate plastics member having a generally Z-shaped cross section defined by a center leg part which at one end is joined through a curved portion to said resiliently-deflectable cantilevered flange, said center leg part at the other end being joined through a curved portion to a generally L-shaped flange, and mounting structure connected to and projecting transversely from an inner surface of said leg part for permitting securement to the end edge of the wall panel.

5. The arrangement according to claim 4, wherein said mounting structure includes a transversely projecting wall structure defining therein a slot, and a securing flange fixed to and projecting transversely from the end edge of said panel member for projection into said slot to lockingly secure said closure strip to said wall panel.

6. The arrangement according to claim 5, wherein said bracket structure as fixed to each said wall panel includes a vertically elongate center part which extends vertically along said end edge and has said upper and lower flanges fixed to and projecting transversely adjacent the upper and lower ends thereof, said center part including a central flat plate which overlies the end edge of the panel and which has said securing flanges projecting outwardly in transverse relation adjacent each vertically extending edge of the central flat plate, said securing flanges respectively engaging the first and second closure strips.

7. A combination comprising:

first and second upright space-dividing wall panels disposed for supportive engagement on a floor, each said wall panel having substantial height and width dimensions and upright end surfaces at opposite ends thereof, said first and second panels being positioned so that the panels in the width dimension thereof extend in angular orientation with respect to one another so that the upright end surface of one said panel is disposed closely adjacent the upright end surface of the other panel;

corner connector structure connected between the adjacent upright end surfaces of said first and second panels for permitting the first and second panels to be disposed in any angular orientation at or within an angular range from about 90° through about 270° as defined between said first and second panels;

said corner connector structure including:

(a) a first bracket structure fixedly connected to the upright end surface of said first panel and including first and second brackets which project generally horizontally outwardly from said end surface adjacent upper and lower edges of said first panel, (b) a second bracket structure fixed to the adjacent end surface of said second panel and including first and second brackets which project generally horizontally outwardly therefrom at elevations similar to the elevation of the respective first and second brackets associated with said first bracket structure, said panels being positioned such that said first brackets directly vertically overlap and said second brackets directly vertically overlap, (c) a vertically elongate connector post positioned to extend vertically between said first and second brackets, said connector post having an upper end thereof disposed directly under the overlapping first brackets and having a lower end thereof disposed directly over the overlying second brackets, and upper and lower vertically aligned connecting elements for respectively joining the upper end of the post to the first brackets and for joining the lower end of the post to the second brackets to structurally connect the first and second panels together at any angular orientation therebetween at least within said angular range, (d) said post having a hollow interior and additionally having openings through a peripheral wall thereof for communication with said hollow interior to permit cabling to pass transversely through said post from said first panel to said second panel, and (e) a pair of vertically elongate closure strips fixed to and extending vertically along each said end surface adjacent opposite sides thereof and projecting outwardly toward said post, each closure strip having a cantilevered flange which projects horizontally in the circumferential direction of the post and which is adapted to circumferentially engage an exterior of the post over a substantial arcuate extent for at least partially enclosing the openings in said post.

8. The combination according to claim 7, wherein a third wall panel is disposed angularly between said first and second panels and has an upright end surface thereof connected to said corner connector, said corner connector having a third bracket structure fixed to the end surface thereof, said third bracket structure being substantially identical to said first bracket structure and having first and second brackets thereon which project outwardly and are disposed to directly vertically overlap the respective first and second brackets associated with the other bracket structures, and a further pair of said vertically elongate closure strips fixed to and extending vertically along said end surface of said third panel and projecting outwardly therefrom toward said post so that the cantilevered flanges of the closure strips on said third panel circumferentially cooperate with the exterior of the post.

9. The combination according to claim 7, wherein each said closure strip is a one-piece elongate plastic member having a mounting structure which is spaced from said cantilevered flange and is fixedly connected to the end surface of the respective panel.

10. The combination according to claim 9, wherein said bracket structure includes a vertically elongate center part which extends between the respective first and second brackets and which overlies and is fixedly secured to the respective end surface, said center part having connecting structure thereon for engagement with the mounting structure associated with the respective connector strips.

11. The combination according to claim 10, wherein the connecting structure includes a pair of sidewardly spaced flanges which project outwardly from the center part of the respective bracket structure and which respectively fixedly engage the mounting structure associated with the respective closure strip.

* * * * *